United States Patent [19]

Windley

[11] Patent Number: 4,804,512

[45] Date of Patent: Feb. 14, 1989

[54] PROCESS FOR OBTAINING SPHERULITE REDUCTION IN POLYAMIDES

[75] Inventor: William T. Windley, Seaford, Del.

[73] Assignee: E. I. Du Pont de Nemours and Company, Wilmington, Del.

[21] Appl. No.: 171,173

[22] Filed: Mar. 21, 1988

Related U.S. Application Data

[63] Continuation of Ser. No. 860,250, May 6, 1986, abandoned.

[51] Int. Cl.[4] ..... D01D 1/02; D01D 5/40

[52] U.S. Cl. ..... 264/211; 264/53

[58] Field of Search ..... 264/49, 211, 176.1, 264/54, 53

[56] References Cited

U.S. PATENT DOCUMENTS

| | | | |
|---|---|---|---|
| 3,506,753 | 4/1970 | Flamand | 264/176.1 |
| 3,538,203 | 11/1970 | Overcashier et al. | 264/176.1 |
| 3,584,090 | 6/1971 | Parrish | 264/176.1 |
| 3,585,264 | 6/1971 | Thomas | 264/176.1 |
| 3,740,380 | 6/1973 | Eichers et al. | 260/78 S |
| 3,756,997 | 9/1973 | Eichers et al. | 260/88.2 S |
| 3,956,020 | 5/1976 | Weininger et al. | 264/49 |
| 3,990,829 | 11/1976 | Frank et al. | 264/176.1 |
| 4,312,960 | 1/1982 | Ort et al. | 264/54 |
| 4,331,619 | 5/1922 | Ching et al. | 264/54 |
| 4,357,288 | 11/1982 | Oas et al. | 264/40.6 |
| 4,386,129 | 5/1983 | Jacoby | 264/49 |
| 4,562,022 | 12/1985 | Li et al. | 264/54 |

OTHER PUBLICATIONS

"Man-Made Fibers Science & Technology", Interscience, 1967, pp. 254–259, by Mark, Atlas & Cernia.

*Primary Examiner*—Jan H. Silbaugh
*Assistant Examiner*—Hubert C. Lorin

[57] ABSTRACT

A process for making a polyhexamethylene adipamide fiber with a spherulite rating of 1 in which a molten polymer of polyhexamethylene adipamide is injected with fluorocarbon and subjected to low shear.

1 Claim, 5 Drawing Sheets

PROCESS FOR OBTAINING SPHERULITE REDUCTION IN POLYAMIDES

This application is a continuation of application Ser. No. 860,250 filed May 6, 1986, now abandoned.

DESCRIPTION

1. Technical Field

This invention relates to polyamide yarns with reduced spherulites and the process for making such yarns.

2. Background

Many thermoplastic fiber-forming polymers are composed of long-chain molecules which organize themselves into crystalline and amorphous regions during melt spinning, the chains becoming more nearly parallel and the crystalline order more perfect during the subsequent drawing operation which is required to develop maximum strength. However, some polymers such as polyamides develop spherulites, which are regions in which the chains pack radially outward from a nucleus to form a spherical structure. Spherulites are undesirable for two reasons—they may scatter light to make otherwise clear polymers cloudy, and they impede the ordering of crystal structure into preferred alignments during drawing and can result in brittleness or lower strength.

Spherulites form and grow when the polymer passes through particular temperature ranges as it cools following extrusion into filaments from a spinneret. For nylon 66, the range is from about 230° C. to 180° C., and the maximum rate of growth occurs at the recrystallization temperature. For nylon 66, this temperature is about 217° C. The rate of growth of spherulites is also influenced by the viscosity of the melted polymer, higher viscosity usually giving lower spherulite growth rate. Since this is a rate phenomenon, the longer the material remains in the critical temperature range, the greater the size of the spherulites. Large diameter filaments which cool slowly are therefore more likely to develop an objectionable degree of spherulites than small ones which pass through the growth temperature range rapidly. Filaments which are spun from polymer flake are more likely to develop objectionable spherulites than product from a continuous polymerizer because re-melted polymer usually contains more nuclei from which spherulites can grow than freshly-prepared polymer.

In conventional melt spinning processes, the polymer is exposed to relatively high shear resulting in substantially reduced melt viscosity and increased temperature.

It has now been found that the reduction of melt viscosity of a polymer may be minimized by reducing polymer shear in the polymer meter pump by using a higher capacity pump which can deliver the required throughput at lower rotational speed, in the spinning filter pack such as by using a more porous filter medium, and/or in the spinneret by providing capillaries of larger diameter. Such measures reduce the work done on the polymer, lowering the heat input and minimizing the decrease in viscosity. It has further been found that by minimizing the reduction in melt viscosity the growth of spherulites can be minimized.

This finding is opposite to the teaching that spherulites may be reduced by filtering the polymer through denser filter media which produce higher shear.

SUMMARY OF THE INVENTION

One process of the present invention is a process for making a polyhexamethylene adipamide fiber having less than 6% nylon 6 comprising heating a hexamethylene diamine and adipic acid salt solution, polymerizing the solution to form a molten polymer, spinning the polymer through a spinning pack, wherein the spinning pack contains a pack filter, the improvement comprising reducing spherulites in the fiber by reducing the shear on the polymer through the pack filter.

Another process of the present invention is a process for making a polyhexamethylene adipamide fiber having less than 6% nylon 6 comprising heating a hexamethylene diamine and adipic acid salt solution, polymerizing the solution to form a molten polymer, spinning the polymer through a spinning pack, the improvement comprising reducing spherulites to a spherulite rating of 1 in the fiber by adding fluorocarbon blowing agent to the molten polymer.

By combining the addition of fluorocarbon with the reduction of shear in the pack filter, a spherulite rating of 1 can be obtained without the formation of cells in the fiber. The preferred fluorocarbon blowing agent is selected from the group comprising dichlorotetrafluoroethane, monochloropentafluoroethane and dichlorodifluoromethane.

The product of the invention is a polyhexamethylene adipamide fiber having less than 6% nylon 6 characterized by: a spherulite rating of 1, and a detectable level of a fluorocarbon selected from the group comprising dichlorotetrafluoroethane, monochloropentafluoroethane and dichlorodifluoromethane.

The suppression of spherulites caused by the combination of low shear and the addition of fluorocarbon blowing agents primarily contributes clarity and high luster to the filaments. This benefit is seen most readily in bright yarns lacking any delustering agents, but the accompanying improvement in physical properties and operability through avoiding broken filaments occurs in both high luster and delustered products. The reduction in shear, which minimizes the reduction in melt viscosity, can reduce the tendency of nylon polymer to gel. In addition, the presence of dissolved fluorocarbon blowing agents permits spinning at somewhat reduced temperature, giving less chance for thermal degradation products of either the polymer or fluorocarbon to contaminate the filaments.

It has been found that small amounts of certain fluorocarbon blowing agents which do not decompose at the temperatures to which a molten polymer capable of forming spherulites is exposed may be injected into a molten polymer ahead of the spinning pack, mixed to distribute and dissolve the fluorocarbon in the polymer, and spun into filaments under conditions which do not form cells in the filaments.

The fluorocarbon lowers the recrystallization temperature so that the polymer is at a lower temperature when it reaches the maximum growth rate for spherulites, and at the same time, the melt viscosity is higher because of the lower temperature. The higher viscosity then impedes the formation of spherulites.

The melt viscosity may be increased by operating the process at as low a melt temperature as is practicable, which also speeds the quenching of the extruded filaments and reduces their residence time in the zone of most rapid spherulite growth. Depending on the level of spherulites existing in a given fiber, the size and/or number of spherulites may be reduced to an acceptable level by either shear reduction, addition of fluorocarbon or both.

Use of fluorocarbons may also produce random cells in filaments. The delustering effect of spherulites is less objectionable in a yarn where cells are desired for delustering or soil hiding, and the effect of spherulites on fiber strength or spinning operability is more important. The presence of sufficient fluorocarbon to form the desired cell size and frequency may suppress spherulites sufficiently to avoid a strength problem. Where cells are not desired and maximum clarity of the polymer is essential, low shear throughout the process is desirable.

The small amounts of fluorocarbons have little or no effect on the relative viscosity, amine ends or carboxyl ends as measured on the product after winding. The presence and type of fluorocarbon in a yarn sample can be identified by Direct Probe Mass Spectrometry.

TEST METHODS

SPHERULITE RATING

Figure 1A:
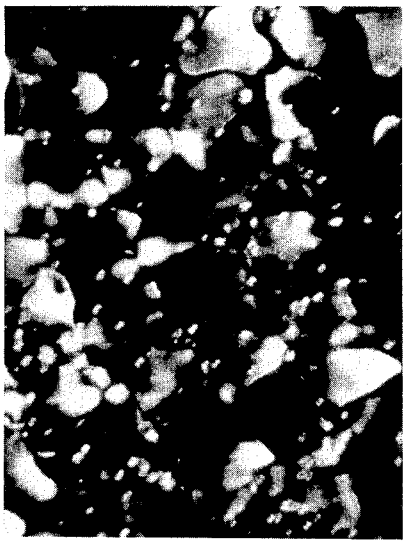
FIG. 1A is a photograph of a cross-section of a nylon 66 yarn with a spherulite rating of 1 taken at a magnification of 340.
Figure 1B:
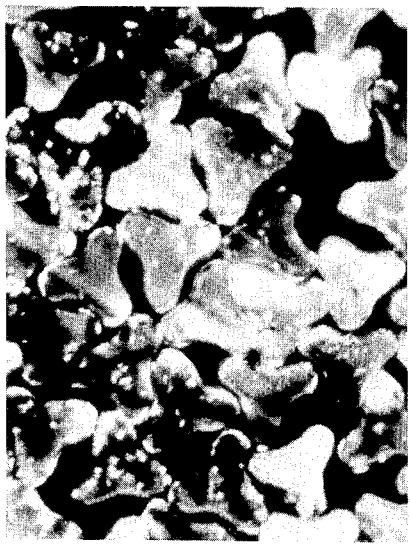
FIG. 1B is a photograph of a cross-section of a nylon 66 yarn with a spherulite rating of 2 taken at a magnification of 340.
Figure 1C:
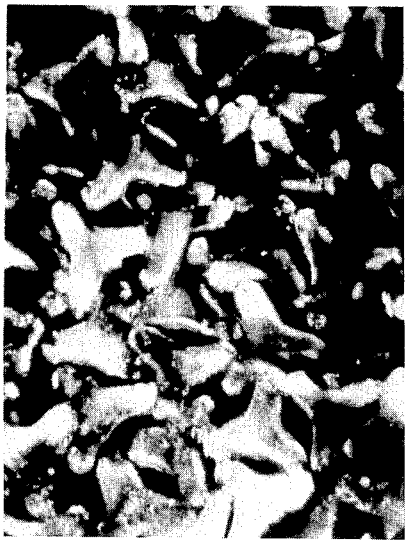
FIG. 1C is a photograph of a cross-section of a nylon 66 yarn with a spherulite rating of 3 taken at a magnification of 340.
Figure 1D:
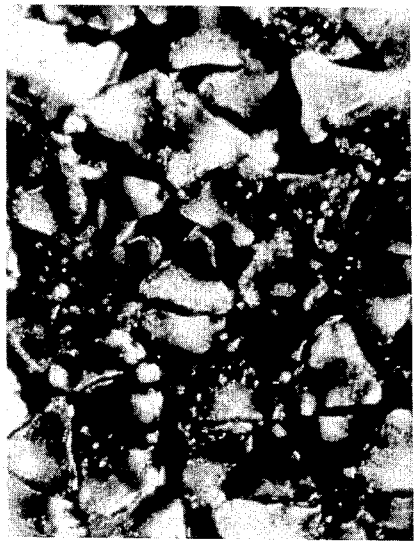
FIG. 1D is a photograph of a cross-section of a nylon 66 yarn with a spherulite rating of 4 taken at a magnification of 340.

The severity of spherulites in filaments is measured by reference to a set of controls. Cross-section slices of filaments embedded in resin are examined by transmitted light with an optical microscope under crossed polarizers. Photographs of the cross-sections are taken at a magnification of 340. The appearance of spherulites is similar to Maltese crosses. The controls are set out in FIGS. 1A, 1B, 1C and 1D. FIGS. 1A shows filaments covered with less than 20% spherulites and has s spherulite rating of 1. FIG. 1B shows filaments covered with between approximately 20% and 40% spherulites and has a spherulite rating of 2. FIG. 1C shows filaments covered with between 40% and 60% spherulites and has a spherulite rating of 3. FIG. 1D shows filaments covered with a more than 60% spherulites and has a spherulite rating of 4.

SPINNING PACK CONSTRUCTION

Figure 2:
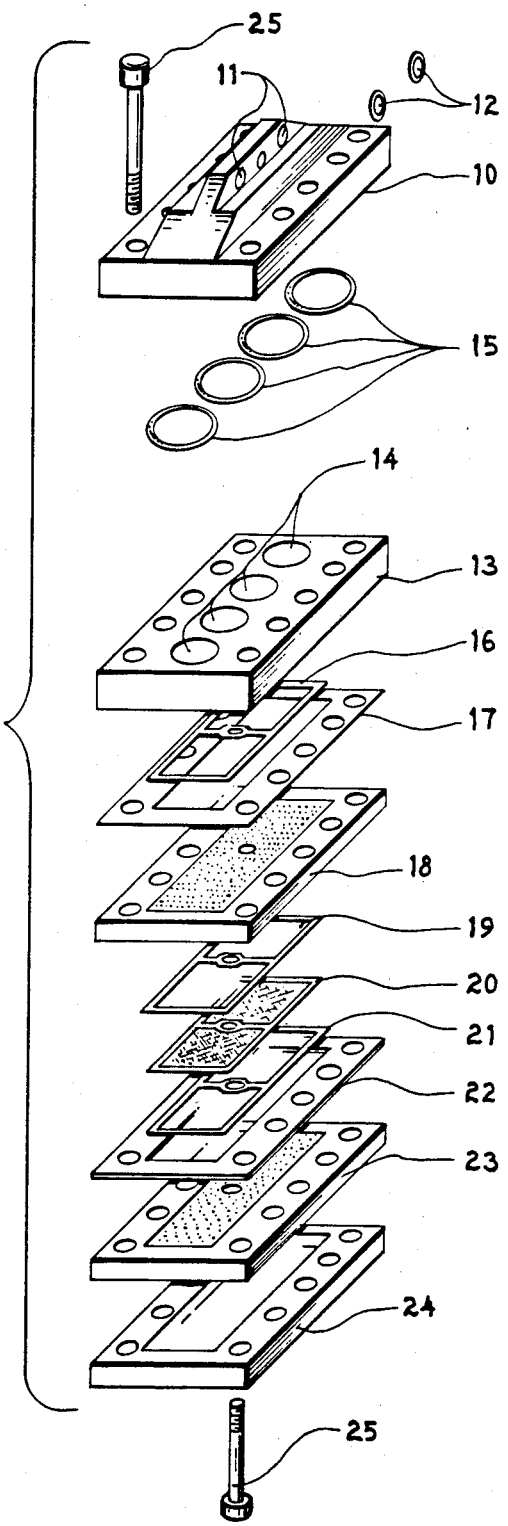
FIG. 2 is a schematic drawing of the spinning pack assembly for Example 1.
Figure 3:
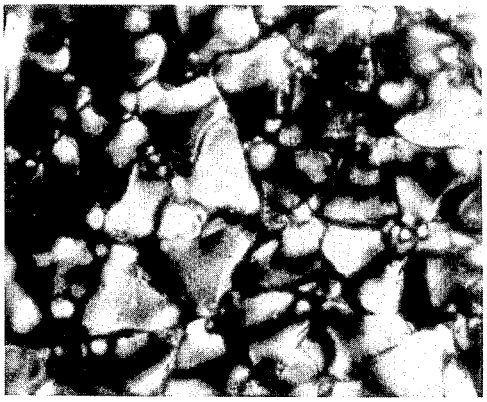
FIG. 3 is a photograph of a cross-section of Example 1 taken at a magnification of 340.
Figure 4:
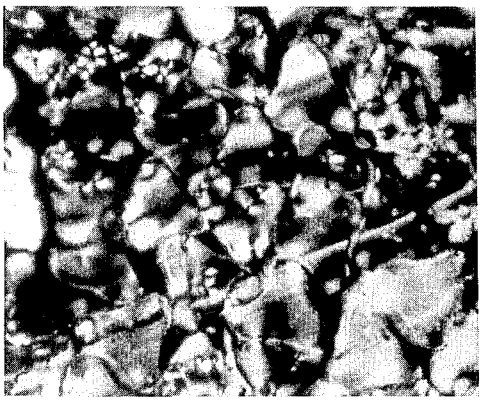
FIG. 4 is a photograph of a cross-section of Example 2 taken at a magnification of 340.
Figure 5:
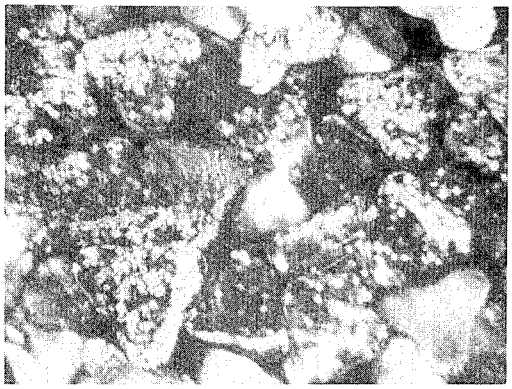
FIG. 5 is a photograph of a cross-section of Control A taken at a magnification of 340.
Figure 6:
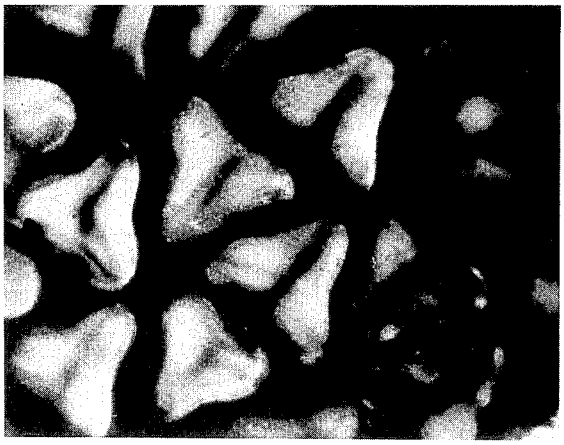
FIG. 6 is a photograph of a cross-section of Example 3 taken at a magnification of 460.
Figure 7:
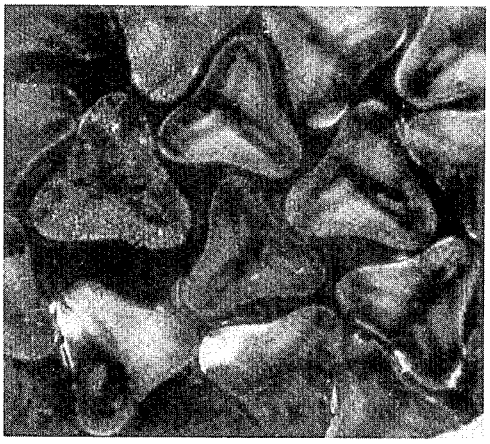
FIG. 7 is a photograph of a cross-section of Control B taken at a magnification of 460.
Figure 8:
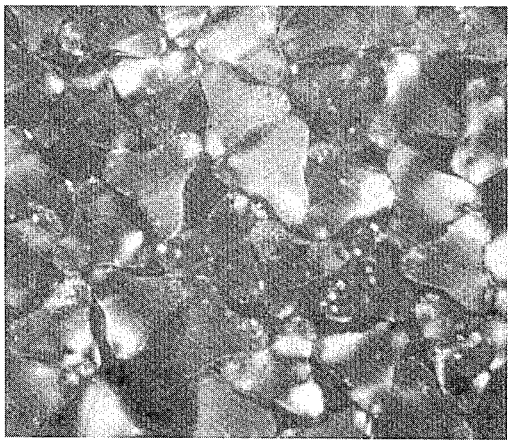
FIG. 8 is a photograph of a cross-section of Example 4 taken at a magnification of 340.
Figure 9:
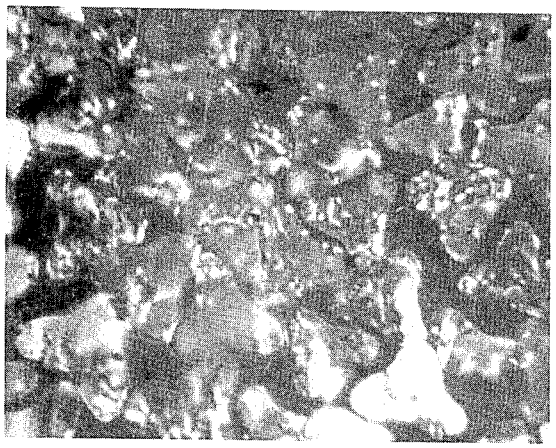
FIG. 9 is a photograph of a cross-section of Example 5 taken at a magnification of 340.
Figure 10:
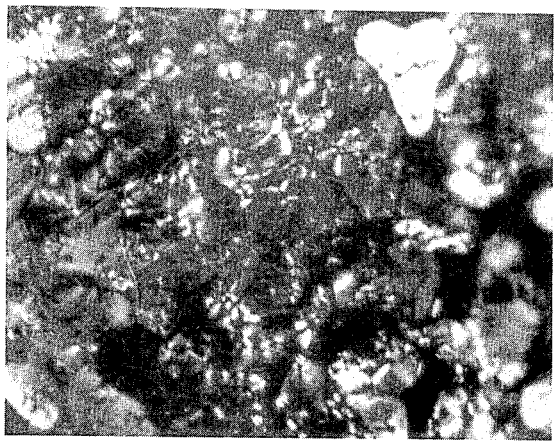
FIG. 10 is a photograph of a cross-section of Example 6 taken at a magnification of 340.

FIG. 2 is a schematic drawing of the spinning pack assembly for Example 1. Molten polymer enters lid 10 of the spinning pack assembly through ports 11, using gaskets 12 for sealing. Holder 13 has four cavities 14, two for each spinning threadline, into which filter media are inserted. The media used for each Example are listed in Table 1, in the order in which they are inserted (reading from bottom to top). A gasket 15 seals between each cavity and lid 10. Following holder 13 is gasket 16, spacer 17 and distributor 18 having 270 holes for each threadline, the holes each having a diameter of 0.158 cm and length 1.59 cm. This is followed by gasket 19, screens 20 comprising one 50 mesh and one 200 mesh with the 200 mesh down, gasket 21 and spacer 22. In Control A, an additional set of components gasket 19 through spacer 22 is installed. Spinneret 23 has capillaries as specified in Table 1. Frame 24 completes the assembly, which is held together by bolts 25 at top and bottom.

TABLE 1

| | | Examples 2 and 3 | | |
|---|---|---|---|---|
| | Examples 1 and 4 | No. | Mesh | Wire Dia. |
| Filter Media | | | | |
| (1) Assemble: | 1 14 × 14 mesh screen | 12 | 60 | 0.191 mm |
| | 1 50 × 50 mesh screen | 8 | 120 | 0.094 mm |
| | 1 80 × 700 mesh screen | 8 | 100 | 0.114 mm |
| | 1 aluminum retainer | 2 | 200 | 0.053 mm |
| | wire | 2 | 150 | 0.066 mm |
| | 1 200 mesh screen | 2 | 120 | 0.094 mm |
| | 1 aluminum retainer | 2 | 100 | 0.114 mm |
| | wire | | | |
| (2) | Seat above with | 2 | 60 | 0.191 mm |
| | 7 tons | | | |
| | Pressure | | Seat with 7 tons pressure | |
| (3) Assemble pack top to bottom | | | | |
| (4) Add: | 20 ml 25–50 grade | | | |
| | powdered stainless steel | | | |
| | 1 50 mesh screen | | | |
| | 1 retainer ring | | | |
| Spinneret | | | | |
| Capillary diameter (cm) | 0.175 | | 0.175 | |
| Capillary length (cm) | 0.030 | | 0.030 | |

| | Control A | Control B | Examples 5 & 6 |
|---|---|---|---|
| Filter Media | | | |
| Assemble: | 1 14 × 14 screen | Same | 1 14 × 14 screen |
| | 1 50 × 50 screen | as | 1 50 × 50 screen |
| | 1 200 × 600 screen | Control | 1 200 × 600 screen |
| | 1 aluminum | A | 1 aluminum |
| | retainer wire | | retainer wire |
| Press to 7 tons | | | Press to 7 tons |
| Add: | 25 ml 50/70 grade | | 20 ml 50/70 grade |
| | powdered s.s | | powdered s.s. |
| Press to 12 tons | | | Press to 12 tons |
| Add: | 2 50 × 50 screens | | 2 50 × 50 screens |
| | 1 14 × 14 screen | | 1 14 × 14 screen |
| Spinneret | | | |
| Capillary Dia. (cm) | 0.175 | 0.055 | 0.175 |
| Capillary Length (cm) | 0.030 | 0.030 | 0.030 |

The particles of powdered stainless steel furnished by Metallurgical Supplies of New Jersey are smaller with higher grade number.

EXAMPLES

In Example 1, FC-114 is injected at a rate of 0.39 gms/min. into a pipe carrying molten nylon 66 polymer, giving 0.056% FC-114 in polymer. There are 24 Kenics static mixers in the pipe after the injection point and a flow inverter is installed after the first 7 Kenics mixers, giving a well distributed mixture of polymer and FC-114. The FC-114 dissolves in the polymer at the pressure of 101.8 kg/cm$^2$ and temperature of 290° C. The polymer then passes through a meter pump producing a shear rate of 14,121 sec$^{-1}$ and through a low-shear spinning pack and spinneret as described in Table 1. The spinneret has a larger diameter capillary than is typical for melt spun filaments, which is preceded by a significantly larger counterbore wherein the polymer resides at low pressure. The exit of this passage is in the form of three radial slots, giving filaments of trilobal shape. As the slowly advancing polymer emerges from the spinneret, filaments are drawn away at a drawdown ratio of 658.3. The filaments are solidified, cold drawn 2.33×, heated on hot rolls, crimped in a hot air jet, deposited on a slowly-moving screen drum, then are tensioned for winding on a package. The pump shear rate on all Examples and Control is approximately the same.

Example 2 is produuced similarly to Example 1 except that in Example 1 the low shear pack is constructed from a combination of screens and coarse powdered metal whereas the low shear pack of Example 2 relies on a series of screens only. FC-114 is injected at a rate of 0.32 gms/min., giving 0.046% FC-114 in polymer. Control A is similar to Examples 1 and 2 except that no fluorocarbon is injected and the spinning pack gives extra-high shear, contributed by the double set of gaskets and screens just above the spinneret.

It is found that when FC-114 is injected into nylon and spun under low shear, the fluorocarbon does not expand to form voids but suppresses the formation of spherulites. Both Examples 1 and 2 have fully acceptable spherulite ratings of 1 while Control A made with higher shear and without fluorocarbon has an unacceptable rating of 4.

In Example 3, FC-114 is injected at a rate of 0.87 g/min. into a pipe carrying a salt blend copolymer of 96% nylon 66 and 4% nylon 6, giving 0.16% FC-114 in the polymer. There are 14 Kenics mixers in the pipe after the injection point and a flow inverter is installed after the first 7 Kenics mixers giving a well distributed mixture of polymer and FC-114. The FC-114 dissolves in the polymer at the pressure of 125.5 kg/cm$^2$ and a temperature of 287° C. The polymer then passes through a meter pump producing a shear rate of 13034 sec$^{-1}$, through a filter to remove foreign matter and gelled polymer then through a low shear spinning pack and spinneret described in Table 1.

As the slowly advancing polymer emerges from the spinneret, filaments are drawn away at a drawdown ratio of 446. The filaments are solidified, cooled by crossflow quench air and are collected.

Several groups of undrawn filaments are then fed simultaneously into a draw crimp machine where they are drawn between two sets of rolls, the second set rotating at a faster rate, and enter a stuffer box crimper. The filaments are heated to some extent by the drawing operation, then nip rolls of the crimper grip the filaments and force them into a chamber having a means to impede their exit so that they are forced to bend in a zig-zag manner at they encounter a mass of previously crimped material. The work done on the filaments by the nip rolls heats them further, making them more pliable and receptive to crimping. The filaments are then cut into staple.

Control B is produced similarly to Example 3 except that no fluorocarbon is added, a high shear spinning pack is used, the spinneret capillary and counterbore as indicated in Table 1 are smaller and more nearly conventional, and consequently the shear rate in the spinneret is higher. The jet velocity of the polymer is therefore higher and the drawdown lower, but the denier of the filaments of both Example 3 and Control B after stretching between the spinneret and the first powered roller are approximately 40.6 denier and after cold drawing are approximately 14.4 denier. Each product is crimped in the mechanical stuffer box, adjusted to give approximately equal crimp elongation under a standard load.

It is found that the filaments of Example 3 employing low shear and fluorocarbon have no cells and a fully-acceptabled spherulite rating of 1, whereas Control B has no cells but an unacceptable spherulite rating of 4.

Example 4 is made with the same low shear spinning pack as Example 1 but without FC-114. The spherulite rating of this item is 2, acceptable for products not requiring maximum clarity. It demonstrates that low shear alone can give fewer spherulites than the extra high shear of Control A.

Examples 5 and 6 use high shear packs similar to those of Examples 1 and 4 except that smaller particles of powdered metal are used. Both have 0.467 gms/min. FC-114 giving 0.067% FC-114 in polymer. In addition, Example 5 has 0.01% calcium acetate which is added to the nylon salt before polymerization. The filaments of both Examples 5 and 6 have spherulite ratings of 1, showing in the case of Example 6 that fluorocarbon can satisfactorily suppress the formation of spherulites when a high-shear spinning pack is used. The filaments of both Example 5 and 6 have cells formed by the expansion of fluorocarbon which is promoted by high shear, but Example 5 has more cells than Example 6, contributed by the calcium acetate.

TABLE 2

| | Ex. 1 | Ex. 2 | Cont. A | Ex. 3 |
|---|---|---|---|---|
| Pack Filter | Low Shr | Low Shr | X-High Shr | Low Shr |
| Freon Rate (g/m) | 0.39 | 0.32 | None | 0.87 |
| Drawdown Ratio | 658.3 | 589.9 | 589.9 | 446 |
| Mech Draw Ratio | 2.33 | 2.60 | 2.60 | 3.0 |
| Cells/Filament | None | None | None | None |
| Spherulite Rating | 1 | 1 | 4 | 1 |
| | **Cont. B** | **Ex. 4** | **Ex. 5** | **Ex. 6** |
| Pack Filter | High Shr | Low Shr | High Shr | High Shr |
| Freon Rate (g/m) | None | None | 0.467 | 0.467 |
| Drawdown Ratio | 52.7 | 596.7 | 589.9 | 589.9 |
| Mech Draw Ratio | 3.0 | 2.63 | 2.60 | 2.60 |
| Cells/Filament | None | None | 9.4 | 5.2 |
| Spherulite Rating | 4 | 2 | 1 | 1 |

I claim:

1. In a process for making a polyhexamethylene adipamide fiber having less than 6% nylon 6 by forming a nylon 66 molten polymer, and spinning the polymer through a spinning pack containing a pack filter to produce a fiber, the improvement comprising reducing spherulites to a spherulite rating of 1 in the fiber, without forming cells in said fiber, by injecting a fluorocarbon blowing agent into the molten polymer in advance of the filter pack while maintaining a low shear throughout the process, the fluorocarbon blowing agent being selected from the group consisting of dichlorotetrafluoroethane, monochloropentafluoroethane and dichlorodifluoromethane.

* * * * *